US006367452B1

(12) United States Patent
Shima et al.

(10) Patent No.: US 6,367,452 B1
(45) Date of Patent: Apr. 9, 2002

(54) FUEL INJECTION SYSTEM

(75) Inventors: Nobuhiko Shima; Tadashi Nonomura, both of Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/594,731

(22) Filed: Jun. 16, 2000

(30) Foreign Application Priority Data

Jun. 18, 1999 (JP) ..... 11-173037

(51) Int. Cl.[7] ..... F02M 41/00
(52) U.S. Cl. ..... 123/457; 123/458
(58) Field of Search ..... 123/457, 456, 123/446, 450, 458, 459, 499, 506, 445, 496

(56) References Cited

U.S. PATENT DOCUMENTS

| | | | | |
|---|---|---|---|---|
| 4,492,534 A | | 1/1985 | Miyaki et al. | 417/386 |
| 4,642,773 A | * | 2/1987 | Miyaki et al. | 123/501 |
| 4,719,889 A | * | 1/1988 | Amann et al. | 123/447 |
| 4,777,921 A | * | 10/1988 | Miyaki et al. | 123/456 |
| 5,094,216 A | * | 3/1992 | Miyaki et al. | 123/506 |

FOREIGN PATENT DOCUMENTS

| | | |
|---|---|---|
| JP | 57-157878 | 9/1982 |
| JP | 62-165083 | 7/1987 |
| JP | A-62-165083 | 7/1987 |
| JP | 11-29244 | 10/1999 |

OTHER PUBLICATIONS

U.S. Application No. 09/291,181.

* cited by examiner

*Primary Examiner*—Willis R. Wolfe
*Assistant Examiner*—Mahmoud Gimie
(74) *Attorney, Agent, or Firm*—Nixon & Vanderhye P.C.

(57) ABSTRACT

A common rail fuel injection system for controlling the opening area of the fuel metering valve inserted in the fuel supply passage for supplying the fuel to the fuel injection pump to control, to a target pressure, fuel pressure in the common rail which holds the fuel delivered from the fuel injection pump. In the steady-state operation, the solenoid current is controlled by duty control at control frequency preset with an importance placed on the control stability. After determining the transient of control from the amount of change in the target common rail pressure which is a target of control, the control frequency is changed to a lower low frequency for a specific time until the common rail pressure reaches the target pressure. As a result, the valve body moves fast, thereby gaining a high control response despite of unsteady behavior of the valve body of the metering valve.

14 Claims, 7 Drawing Sheets

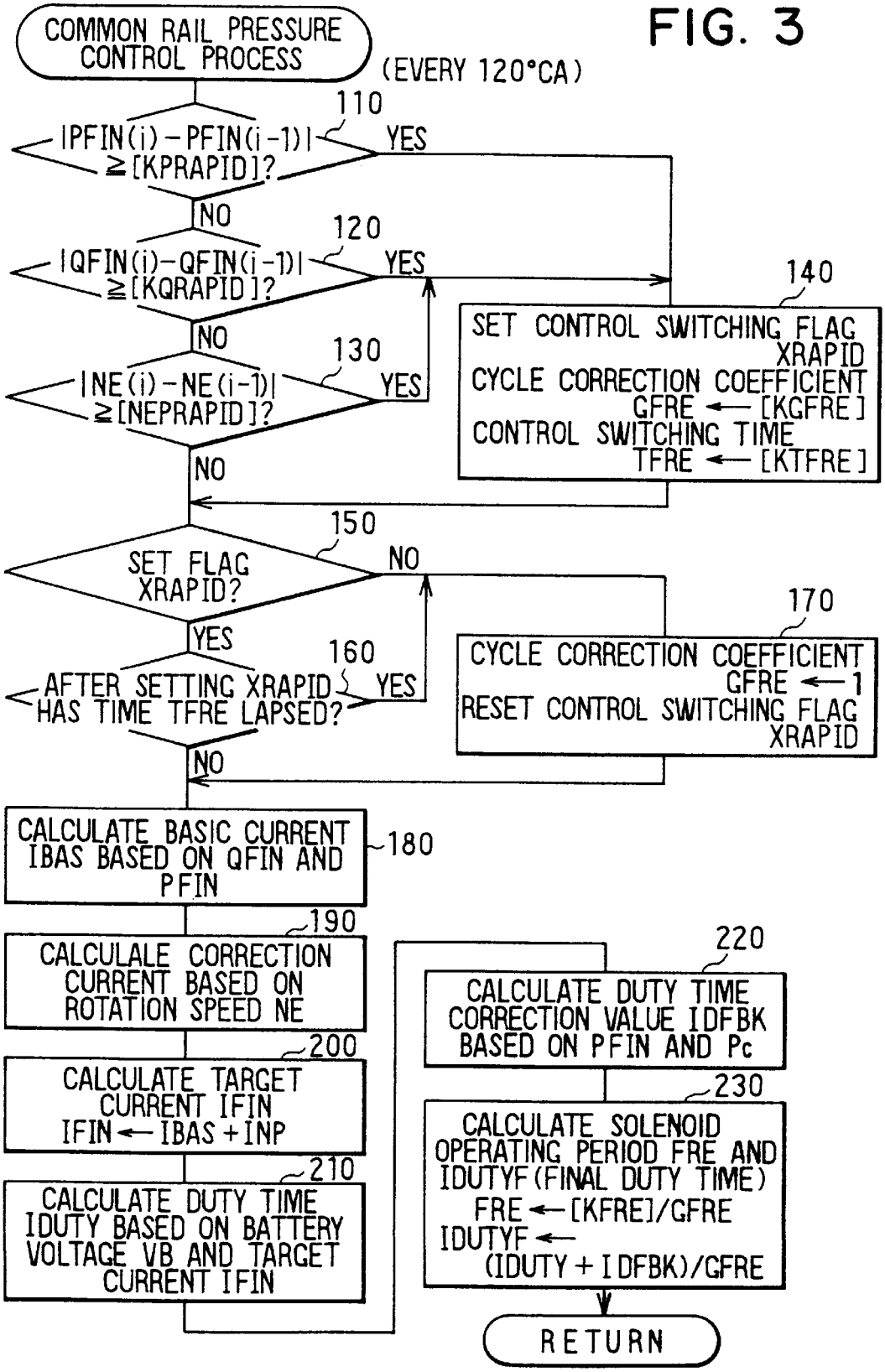
FIG. 3
COMMON RAIL PRESSURE CONTROL PROCESS
(EVERY 120°CA)
110
|PFIN(i)−PFIN(i−1)| ≧[KPRAPID]?
YES
NO
120
|QFIN(i)−QFIN(i−1)| ≧[KQRAPID]?
YES
NO
130
|NE(i)−NE(i−1)| ≧[NEPRAPID]?
YES
NO
140
SET CONTROL SWITCHING FLAG XRAPID
CYCLE CORRECTION COEFFICIENT GFRE ← [KGFRE]
CONTROL SWITCHING TIME TFRE ← [KTFRE]
150
SET FLAG XRAPID?
NO
YES
160
AFTER SETTING XRAPID HAS TIME TFRE LAPSED?
YES
NO
170
CYCLE CORRECTION COEFFICIENT GFRE ← 1
RESET CONTROL SWITCHING FLAG XRAPID
CALCULATE BASIC CURRENT IBAS BASED ON QFIN AND PFIN
180
190
CALCULALE CORRECTION CURRENT BASED ON ROTATION SPEED NE
200
CALCULATE TARGET CURRENT IFIN
IFIN ← IBAS + INP
210
CALCULATE DUTY TIME IDUTY BASED ON BATTERY VOLTAGE VB AND TARGET CURRENT IFIN
220
CALCULATE DUTY TIME CORRECTION VALUE IDFBK BASED ON PFIN AND Pc
230
CALCULATE SOLENOID OPERATING PERIOD FRE AND IDUTYF (FINAL DUTY TIME)
FRE ← [KFRE]/GFRE
IDUTYF ← (IDUTY + IDFBK)/GFRE
RETURN

FUEL INJECTION SYSTEM

CROSS-REFERENCE TO RELATED APPLICATION

The present invention is related to Japanese patent application No. Hei. 11-173037, filed Jun. 18, 1999; the contents of which are incorporated herein by reference.

FIELD OF THE INVENTION

The present invention relates generally to a fuel injection system, and more particularly, to a fuel injection system for controlling fuel delivery from a fuel injection pump that delivers fuel synchronously with rotation of an internal-combustion engine.

BACKGROUND OF THE INVENTION

In conventional fuel injection systems, such as disclosed in JP-A No. S59-65523 (U.S. Pat. No. 4,492,534), a fuel metering valve is provided in a fuel feed line. The fuel feed line is positioned between a fuel feed pump, for drawing fuel from a fuel tank, and a fuel injection pump. The fuel metering valve is regularly opened and closed for metering the fuel. The amount of time this valve is opened and closed is controlled to thereby meter the quantity of fuel drawn into the fuel injection pump.

In operation, however, the quantity of fuel drawn increases relative to change in the valve opening timing since the fuel metering valve is operated from a full-closed position to a wide-open position or vice versa. Therefore, in the conventional fuel injection system, the quantity of fuel altered by changing the valve opening timing of the fuel metering valve increases with change. Therefore, it is impossible to precisely control fuel quantity drawn into the fuel injection pump.

The present applicant, therefore, changed the fuel metering valve control from that described above to controlling the opening area of the valve to precisely control the quantity of fuel drawn into the fuel injection pump (and accordingly the amount of fuel delivery from the fuel injection pump) JP-A No. H10-104714 (JP-A-11-294244). In the device proposed herein, a solenoid valve is used to meter fuel. The opening area of this valve varies in response to changing current supplied to the solenoid. Control of this current, thereby enables precise control of the opening area of the fuel metering valve and the amount of fuel drawn into the fuel injection pump according to the operating conditions of the internal-combustion engine.

To control this current, a duty control is used (PWM control). Here, the solenoid energizing time ratio (duty ratio) per control cycle is set. The current is supplied to the solenoid for a specific time period every preset control cycle according to the duty ratio.

However, the following problems ① and ② occur if the duty control frequency is set too low (if the control cycle is set too long). Moreover, problems ③ and ④ arise if the control frequency is set too high (if the control cycle is set too short).

① During low-frequency control (see FIG. 6A) with the duty control frequency set low, the amplitude of the current supplied to the solenoid (solenoid current) is larger than that for the high-frequency control (see FIG. 6B). Therefore, as shown in FIGS. 6C and 6D, the valve body of the fuel metering valve, which displaces according to solenoid current, moves unsteady as compared to the high-frequency control. The result is that the fuel quantity delivered from the fuel injection pump varies. Therefore, if the duty control frequency is set too low, a stabilized quantity of fuel is not delivered from the fuel injection pump.

② Also, a mean value of solenoid current (mean current) is controlled for controlling the position of the fuel metering valve body to control the solenoid energizing time (duty ratio) per control cycle. The duty ratio is changed by calculations on the control device side which are used by the control after the completion of one duty control cycle and a transfer to the next control cycle. Therefore, a response delay occurs between the calculated duty ratio at the control device side and the reflected duty ratio of the solenoid current. In the case of low-frequency control, as shown in FIG. 7A, the time per control cycle becomes long as compared with that in the high-frequency control shown in FIG. 7B. Accordingly, the response delay time also becomes long. Therefore, if the duty control frequency is set too low, a lowered control response will result. The quantity of fuel delivered from the fuel injection pump, therefore, cannot be controlled quickly according to the operating condition of the internal-combustion engine.

③ In high frequency duty control, alternatively, solenoid current is controlled by controlling the solenoid energizing time (duty ratio) per control cycle. However, when the control device such as a microcomputer, having a digital circuit outputs a driving signal (drive pulse) for the duty control, the minimum amount of drive pulse change depends on the pulse output resolution of the control device. In this case, the higher the duty control frequency (equating to shorter control frequency), the more the duty ratio resolution becomes rough, resulting in a deteriorated control accuracy.

For example, if the duty control cycle is set at 10 msec., the pulse output resolution of the control device is 1 msec. Here, the duty control of the solenoid current can be performed at a resolution of 10%. However, to perform the duty control of the solenoid current at the control cycle of 5 msec. with the same control device, the duty control resolution will be 20%, which lowers the solenoid current control accuracy.

Therefore, if the duty control frequency is set too high when using a microcomputer (which is generally used as a control device) in the fuel injection system, the control accuracy of the solenoid current (accordingly, amount of fuel delivered from the fuel injection pump) is lowered.

④ If the control frequency is set too high during duty control, hysteresis results. Here, as shown in FIG. 8B, increase in valve opening (lift) relative to duty ratio (duty) change differs from decrease in valve opening (lift) relative to duty ratio change (duty) during the closing of the fuel metering valve. Therefore, it is impossible to unequivocally control the opening area (and accordingly the quantity of fuel delivered from the fuel injection pump) during the opening and closing of the fuel metering valve despite using the same duty ratio.

To accurately control solenoid current with duty control at a constant control frequency, the duty control must be carried out at such a low frequency that no hysteresis occurs between valve opening and closing. Therefore, it is necessary to set the duty control frequency so that the problems ① to ④ do not occur. Therefore, conventionally, the duty control frequency is set at the optimum value applicable to the operation characteristics of the fuel injection system being controlled.

It is, however, difficult to adapt the duty control frequency to the optimum value under all operating conditions for the fuel injection system being controlled. The control characteristics vary depending on the type of control the designer believes important when setting the control frequency. That is, when the control frequency is set with importance placed on steady state control (control stability), good control response is not achieved. Likewise, when the control frequency is set with importance placed reversely on transient operation control (control response), the control stability is sacrificed.

To prevent control accuracy deterioration caused by the hysteresis phenomenon stated in ④, JP-A Nos. S57-157878 (JP-A-57-157878) and S62-165083 (JP-A-62-165083) disclose the solenoid energizing time or de-energizing time per control cycle is secured by changing the control frequency according to the duty ratio of the drive pulse when performing the duty control of the solenoid current. Specifically, the control frequency is lowered during a small or large duty ratio, thereby preventing the hysteresis phenomenon. In the variable control of the control frequency, the control frequency is unequivocally set in accordance with the duty ratio in either of the steady-state operation control and the transient operation control. It is therefore impossible to gain both control response and control stability. The present invention was developed in light of these drawbacks.

SUMMARY OF THE INVENTION

It is therefore an object of the present invention to ensure both steady-state operation control (control stability) and transient operation control (control response) to provide optimum fuel delivery control from the fuel injection pump at all times.

The present achieves these and other objects by providing a fuel injection system having a fuel injection pump which pressurizes fuel from a feed pump to generate high pressure fuel. The fuel injection pump delivers the high-pressure fuel to an internal-combustion engine. A fuel metering valve is provided which includes a solenoid valve and has an opening area that varies with an amount of current supplied to the solenoid valve. The fuel metering valve controls a pressure of the high-pressure fuel being delivered from the feed pump. A control means is provided for duty controlling the amount of current supplied to the solenoid valve of the fuel-metering valve so that a target state of fuel being delivered from the fuel injection pump is controlled according to an operating condition of the internal-combustion engine. The control means has a control frequency changing means that changes the duty control frequency according to the operating condition of the internal-combustion engine.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein:

FIG. 3 is a flowchart of a rail pressure control executed by an ECU according to the present invention;

DETAILED DESCRIPTION OF THE PREFERRED EMBODIMENTS

The preferred embodiments of a fuel injection system according to the present invention will hereinafter be explained with reference to the accompanying drawings.

Figure 1:
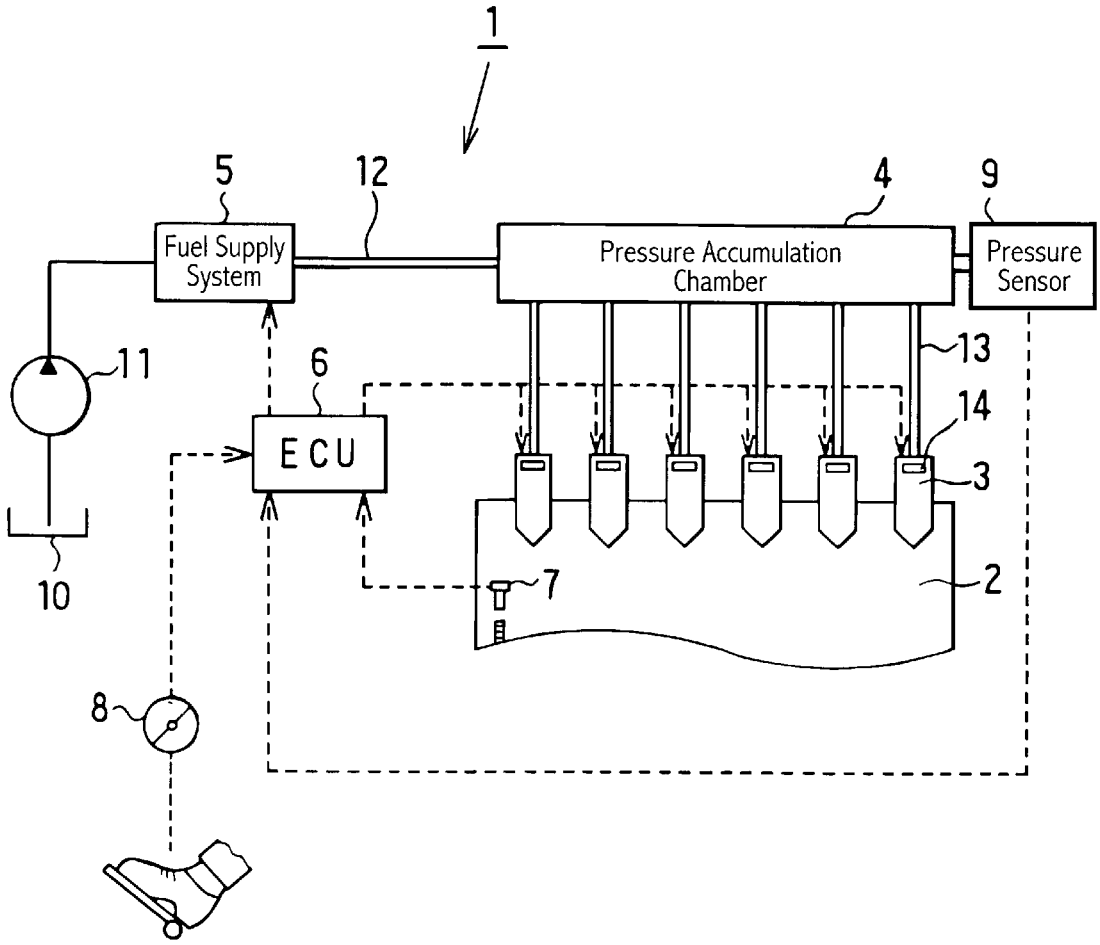
FIG. 1 is a schematic view of a rail-type fuel injection system according to the present invention.

As shown in FIG. 1, the common rail-type fuel injection system 1 of the present invention has a fuel injection valve (an injector) 3 through which fuel is supplied by injection to each cylinder of a six-cylinder diesel engine 2. Fuel injection system 1 also has a pressure accumulation chamber (a common rail) 4 for holding the high-pressure fuel supplied to the injector 3, a fuel supply system 5 for delivering the high-pressure fuel to the common rail 4, and an electronic control unit (ECU) 6 for controlling these devices.

The ECU 6 consists of a microcomputer including a CPU, ROM, and RAM. ECU 6 receives various parameters including engine speed NE, accelerator position, ACC, etc. These parameters represent the operational state of the diesel engine 2. These parameters are detected by engine speed sensor 7, accelerator sensor 8, etc. ECU 6 computes a target fuel pressure (a target common rail pressure PFIN) to control fuel combustion in diesel engine 2 for optimum operating conditions according to the state of operation of the diesel engine 2 thus detected. This control performs the feedback control of the common rail pressure to control fuel supply system 5 so that the actual fuel pressure (actual common rail pressure Pc) detected by common rail pressure sensor 9 inserted in the common rail 4 agrees with the target common rail pressure PFIN.

Fuel supply system 5 takes in low-pressure fuel from fuel feed pump 11, which supplies fuel from fuel tank 10 according to control commands from ECU 6, and pressurizes this fuel to the common rail pressure PFIN. Fuel supply system 5 then sends high-pressure fuel into common rail 4 through fuel supply line 12.

Each injector 3 is connected, by fuel line 13, to common rail 4. High-pressure fuel accumulated in the common rail 4 is injected into the combustion chamber of each cylinder of the diesel engine 2 by opening and closing control valve 14 installed in each injector 3.

Control valve 14 is opened and closed in response to an injector control command supplied from the ECU 6. This injector control command is used to control fuel injection quantity and fuel injection timing. The injector control command is calculated according to detection signals supplied from the engine speed sensor 7 and the accelerator sensor 8, and is outputted from the ECU 6 at a specific timing based on detection signals from the engine speed sensor 7 and an cylinder discriminating sensor (not shown).

Figure 2:
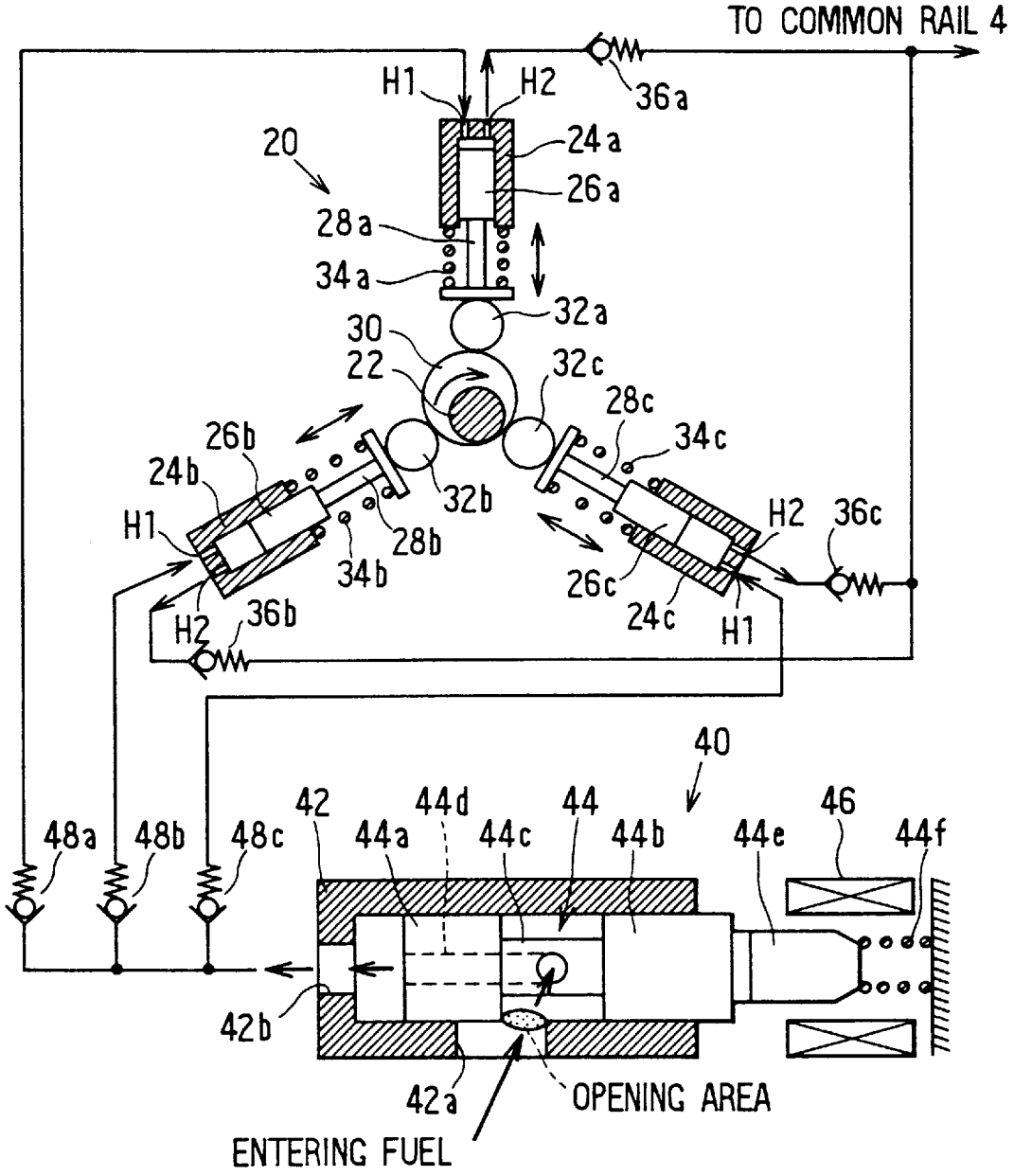
FIG. 2 is a schematic view of a fuel supply system according to the present invention.

With reference to FIG. 2, the fuel supply system 5 is explained. As shown in FIG. 2, the fuel supply system 5 includes a rotary pump 20, used as a fuel injection pump, and a fuel metering valve 40 which meters the quantity of fuel drawn into the rotary pump 20 (introduced fuel quantity). Rotary pump 20 has a drive shaft 22 coupled with the rotating shaft of the diesel engine 2, three cylinders 24*a*, 24*b* and 24*c* radially arranged at 120 degree intervals around drive shaft 22, and plungers 26*a*, 26*b* and 26*c* slidably mounted inside of the cylinders 24*a*, 24*b* and 24*c*.

On the drive shaft 22 side of each of the plungers 26*a* to 26*c*, rods 28*a*, 28*b* and 28*c* are provided projecting from a center. On the inward ends of rods 28*a* to 28*c*, contact portions 32*a*, 32*b* and 32*c* are provided. These contact portions are offset relative to drive shaft 22 and contact an eccentric cam 30. Furthermore, springs 34*a*, 34*b* and 34*c* are provided between the contact portions 32*a* to 32*c* and the cylinders 24*a* to 24*c*, for pressing the plungers 26*a* to 26c toward the drive shaft 22.

In the rotary pump 20, therefore, the drive shaft 22 and accordingly the eccentric cam 30 rotate one turn per rotation of the rotating shaft of diesel engine 21. This operates plungers 26*a* to 26*c* one stroke within cylinders 24*a* to 24*c*. Since the cylinders 24*a* to 24*c* are arranged radially at intervals of 120 degrees, the movement of the plungers 24*a* to 24*c* in the cylinders 24*a* to 24*c* will be shifted in phase by 120° CA of the diesel engine 2.

Next, at the end of cylinders 24*a* to 24*c*, opposite drive shaft 22, inlet ports Hi introduce fuel into the cylinders 24*a* to 24*c* when plungers 26*a* to 26*c* have moved to the drive shaft 22 side. Likewise, outlet port H2 discharges pressurized fuel out cylinders 24*a* to 24*c* when the plungers 26*a* to 26*c* have moved to the opposite side of the drive shaft 22.

The outlet port H2 of each of the cylinders 24*a* to 24*c* is connected to the fuel supply line 12 through check valves 36*a*, 36*b* and 36*c* for checking the back flow of the fuel into the cylinders 24*a* to 24*c*. Therefore, high-pressure fuel is supplied from the fuel supply system 5 into the common rail 4 three times per rotation of the diesel engine 2.

Fuel metering valve 40 meters the quantity of fuel (introduced fuel quantity) flowing into the cylinders 24*a* to 24*c* when the plungers 26*a* to 26*c* of the rotary pump 20 have moved to the drive shaft 22 side to draw the fuel into the cylinders 24*a* to 24*c*. Fuel metering valve 40 is comprised of cylinder 42 which forms a part of the fuel supply passage leading to rotary pump 20, a valve body 44 slidably inserted in the cylinder 42 to meter the quantity of fuel passing through the cylinder 42, and a solenoid 46 for changing the sliding position of the valve body in the cylinder 42 with electromagnetic force.

In cylinder 42, in the side wall which serves as the sliding surface of the valve body 44, an inlet port 42*a* introduces fuel supplied from the fuel feed pump 11, into the cylinder 42. In the end face, opposite solenoid 46 of the valve body 44, outlet port 42*b* discharges fuel that has entered cylinder 42 through the inlet port 42*a*. This fuel is discharged to the rotary pump 20 side. This outlet port 42*b* is connected to the inlet port H1 formed in the cylinders 24*a* to 24*c* on the rotary pump 20 side via check valves 48*a*, 48*b* and 48*c* which prevents back flow, into the cylinder 42, of the fuel discharged to the rotary pump 20.

Valve body 44 is mounted in cylinder 42. Valve body 44 includes a pair of sliding portions 44*a* and 44*b* which slide along the side wall in cylinder 42. Valve body 44 has a connecting portion 44*c* connecting the sliding portions 44*a* and 44*b* at about the same intervals as the opening diameter of the inlet port 42*a* of the cylinder 42. Valve body 44 is moved to the rearmost end position, opposite outlet port 42*b*, by electromagnetic force from solenoid 46 when energized. In this state, the sliding portion 44*a* closes the inlet port 42*a*, blocking the fuel supply passage from the fuel feed pump 11 to the rotary pump 20.

In the connecting portion 44*c* and the sliding portion 44*a* on the outlet port 42*b* side, a guide hole 44*d* is drilled to guide fuel entering cylinder 42 from the inlet port 42*a*, to the outlet port 42*b* side. Therefore, when valve body 44 is positioned at the outlet port 42*b* side, closing inlet port 42*a*, the fuel feed pump 11 supplies fuel to the rotary pump side 20 through the inlet port 42*a*, guide hole 44*d*, and outlet port 42*b*.

Since the opening area of the inlet port 42*a* varies with the position of the valve body 44, the fuel quantity drawn into cylinders 24*a* to 24*c* of rotary pump 20 through the metering valve 40 is metered by controlling the sliding position of valve body 44 with solenoid 46.

Solenoid 46 has a rod 44*e* in the sliding portion 44*b* proximate solenoid 46, to allow electromagnetic force from solenoid 46 to displace valve body 44. A spring 44*f* is provided at the end of rod 44*e* to press valve body 44 toward the outlet port 42*b* side of cylinder 42.

As a result, in fuel metering valve 40, if the current supply to the solenoid 46 is halted, spring 44*f* presses sliding portion 44*a* into the inner wall surface of outlet port 42*b* side of the cylinder 42. As a result, the opening area of inlet port 42*a* reaches its maximum, thereby maximizing fuel flow into rotary pump 20. Furthermore, when current is supplied to solenoid 46, the valve body 44 moves to the solenoid 46 side by electromagnetic force. Here, inlet port 42*a* is gradually closed according to the amount of current supplied to solenoid 46. Therefore, the amount of fuel drawn into rotary pump 20 decreases with increased current. Next, referring to FIG. 3, common rail control executed by ECU 6 (particularly, by the CPU) to control the common rail pressure is described. The common rail pressure control provides feed-back control of the opening area of fuel metering valve 40. Specifically, the current supplied to the solenoid 46 of the fuel metering valve 40 is controlled so that the actual common rail pressure Pc detected by the common rail pressure sensor 9 will become the target common rail pressure PFIN. This processing is carried out by the ECU 6 every 120° C. A of diesel engine 2 in synchronism with the fuel discharge cycle of the rotary pump 20.

In this processing, the solenoid 46 driving cycle FRE (i.e., the control cycle for duty-controlling the solenoid current) and the solenoid 46 energizing time (final energizing time) I DUTYF per cycle are control quantities necessary for duty-controlling the solenoid current by turning on and off the switching element provided in the solenoid 46 energizing path. These control quantities are finally calculated in a solenoid 46 driving pulse output.

As shown in FIG. 3, when the common rail pressure control begins, the transient decision for determining the transient time of common rail pressure control is carried out at S110 to S130 ("S" stands for "Step") of the decision.

That is, first at S110 determines whether the absolute value of deviation (i.e., the amount of change in the target common rail pressure PFIN) between the present value PFIN (i) and the previous current PFIN ((i-I) of the target common rail pressure PFIN (control target) exceeds a preset transient decision value KPRAPID.

Also, when S110 determines that the change in common rail pressure PFIN is below the transient decision value KPRAPID, the processing goes to S120. S120 determines whether the absolute value of deviation between the present value QFIN (i) and the previous current QFIN (i-l) of the target quantity of fuel injection QFIN from the injector 3 (i.e., the amount of change in the target quantity of fuel injection QFIN) exceeds a preset transient decision value KQRAPID.

Furthermore, if S120 determines the change in target fuel injection quantity is below the transient decision value QPRAP1D, S130 then determines whether the absolute value of deviation between the present value NE(i) and the previous value NE (i-1) of the speed of diesel engine 2 (i.e., the amount of change in the speed NE) exceeds the preset transient decision value NEPRAPID.

When S130 determines that the change in speed NE is under the transient decision value NEPRAPID, the processing concludes that the current amount of change is not in the transient time of control. Therefore, the processing goes to step S150. Contrarily, at steps S110 to S130, if the change in the target common rail pressure PFIN, target fuel injection quantity QFIN, or speed NE is over the transient decision value, the processing concludes that the current amount of change is in the transient time of control. Therefore the processing proceeds to S140.

At S110 and S120, the target fuel injection quantity QFIN and the target common rail pressure PFIN are target control values for injector control and common pressure control calculated based on speed NE of the diesel engine 2, accelerator position ACC, etc. in a control amount operation.

The target fuel injection quantity QFIN, target common rail pressure PFIN, and the speed NE used in transient decision of control at S130, are used to set control quantities (the driving cycle FRE and the final energizing time IDUTYF) for duty control of the solenoid 46 as described below. Here, at S110 to S130, the transient time of control is not determined from the amount of change in the control quantities for duty control (driving cycle FRE and final energizing time I DUTYF), but is determined from the amount of change in parameters used to set the control quantities. This enables quick decision of transient without a delay in response.

Next, when the control during a transient time is decided by the transient decision at S110 to S130, the processing goes to S140. Here, a control changeover flag XRAPID is set for changing the control frequency to a lower low frequency than in steady-state operations during duty control of the solenoid current. Also, a preset value KGFRE (in the present embodiment, a value smaller than 1; e.g., 0.5) is set as a cycle correction factor GFRE. KGFRE is for making the duty control cycle longer than during steady-state operation (i.e., lowering the duty control frequency lower than during steady-state operation). Furthermore, the preset time KTFRE (e.g., 75 msec.) is set as the control changeover time TFRE which expresses a duration for changing the control frequency to a lower low frequency than that during steady-state operation. Thereafter, the processing proceeds to S150.

The time KTFRE is set as the control changeover time TFRE is shorter than the time required for the actual common rail pressure Pc to reach the target common rail pressure PFI. This is accomplished by executing the common rail pressure control after the transient decision of control.

Next, S150 determines whether the changeover flag XRAPID has been set. When this flag is set, the processing proceeds to S160. Here, S160 determines whether the control changeover time TFRE has passed after setting the control changeover flag XRAPID. If the control changeover time TFRE has not passed, the processing proceeds to S180. If this flag is not set, of if the control changeover time TFRE passes after setting the control changeover flag XRAPID at S160, processing moves to S170. Here, the value "1" is set as the cycle correction factor GFREE to reset the duty control cycle to steady-state operation. Then, the control changeover flag XRAPID is set and proceeds to S180.

Figure 4A:
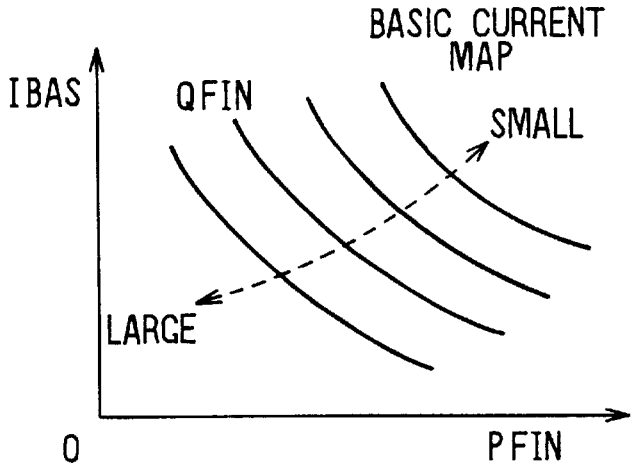
FIG. 4A is a graphical view of a control variable calculation used to carry out rail pressure control according to the present invention.

At S180, the basic current amount is calculated according to the target fuel injection quantity QFIN and the target common rail pressure PFIN by using the basic current amount calculation map stored in a ROM as shown in FIG. 4A.

The basic current amount calculation map maintains an increase in the basic amount of current IBAS with a decrease in target fuel injection quantity QFIN and target common rail pressure PFIN. When the fuel quantity (target fuel injection quantity QFIN) supplied to each cylinder of the diesel engine 2 from the injector 3 or target common rail pressure PFIN becomes smaller, the fuel quantity supplied to common rail 4 also becomes smaller. Accordingly, the opening area of the metering valve 40 must be decreased.

Figure 4B:
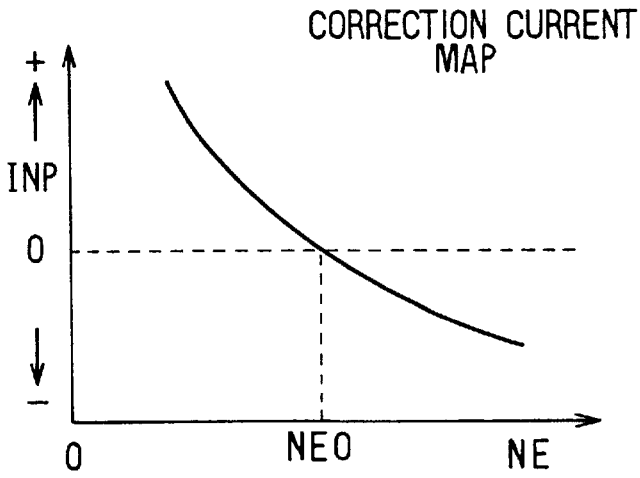
FIG. 4B is a graphical view of a control variable calculation used to carry out rail pressure control according to the present invention.

At S190, the correction amount of current INP relative to the basic amount of current is calculated from the speed NE of the diesel engine 2, using the correction current amount calculation map shown in FIG. 4B. The fuel quantity supplied to rotary pump 20 varies according to the speed NE of the diesel engine 2 if the amount of current flowing to the solenoid 46 remains constant. Specifically, fuel quantity supplied to the rotary pump 20 is reduced with increased speed Ne. Therefore current supplied to solenoid 46 must be decreased to increase the opening area of the metering valve. The correction amount of current I NP, therefore, is used for correcting the basic amount of current IBAS calculated at S180, in accordance with the speed NE of the diesel engine 2.

When setting the basic current amount calculation map, In FIG. 4B, in the high region where the speed NE is higher than a reference speed NEO, the negative value is set to decrease with increasing speed NE. Where the speed NE is lower than the reference speed NEO, the positive value is set to increase with decreasing speed NE.

Next, after calculating the basic amount of current I BAS and the correction amount of current I NP, I BAS and I NP are added at step S200 to calculate the target amount of current IFI (=I BAS+I NP) supplied to the solenoid 46. Furthermore, at step S210, the target amount of current I FIN is converted to the solenoid 46 energizing time I DUTYF at the preset control cycle. This present control cycle is the driving pulse width for duty control of the current flowing to the solenoid 46 according to the pulse width modulation signal (PWM signal).

Figure 4C:
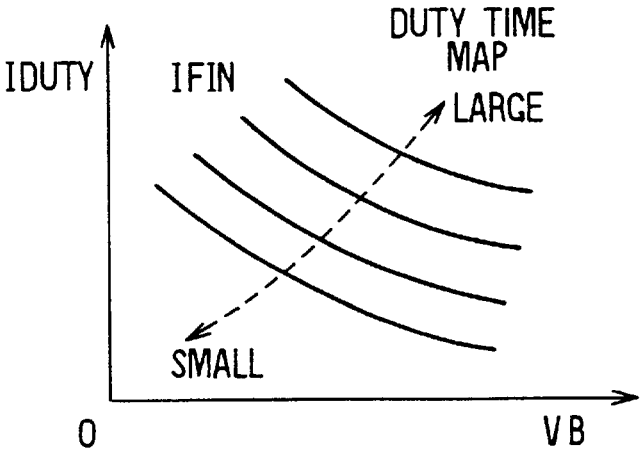
FIG. 4C is a graphical view of a control variable calculation used to carry out rail pressure control according to the present invention.

That is, in the present embodiment, a switching element is provided in the current supply path from a battery to solenoid 46. The switching element is driven by the PWM signal to perform the duty control of the current flowing into the solenoid 46 (i.e., opening metering valve 40). At S210, the energizing time I DUTY per control cycle for duty control is calculated. The energizing time calculation map shown in FIG. 4C is used to calculate the energizing time I DUTY. The energizing time I DUTY is set based on the target amount of current I FIN and the battery voltage VB. That is, the energizing time I DUTY is set to increase with increasing target current IFIN and decreasing battery voltage VB.

At S210, therefore, the switching element is turned on at the preset control cycle to set the energizing time I DUTY for energizing the solenoid 46. Then, at S220, the energizing time correction amount I FBK is calculated to null an oil pressure deviation ΔP based on the oil pressure deviation ΔP between the target common rail pressure P FIN and the actual common rail pressure Pc.

The energizing time correction amount I FBK is a feedback correction amount relating to the energizing time I DUTY calculated at S210. At S220, the energizing time correction amount I FBK is calculated by the procedure: addition of the product of the oil pressure deviation ΔP and the proportional constant Kp, the product of the integral of the oil pressure deviation ΔP and the integral constant Ki, and the product of the differential value of the oil pressure deviation ΔP and the differential constant Kd, and renewal of the energizing time correction amount I FBK by the sum of these products.

Finally at S230, the driving cycle FRE of the solenoid for duty controlling the solenoid current and the final energizing time I DUTYF for energizing the solenoid 46 with the switching element actually turned on in synchronization with the driving cycle FRE are calculated by using the latest cycle correction factor GFRE set at S140 or S170.

That is, at S230, the driving cycle FRE (=KFRE/GFRE) of solenoid 46 is calculated by dividing the reference value KFRE of the driving cycle for duty controlling the solenoid current at a control frequency (e.g., 200 Hz) set at S140 or S170 with importance placed on control stability by the cycle correction factor G FRE (0.5 or 1). The final energizing time I DUTYF (=(I DUTY +I DFBK)/GFRE) which is the energizing time per actual driving cycle of the solenoid 46 is calculated by dividing, by the cycle correction factor GFRE (0.5 or 1) set at S140 or S170, the sum of the energizing time I DUTY per control cycle (=KFRE) of the solenoid 46 and its correction amount I DFBK given by calculations at S210 and S220 respectively and corresponding to the reference value KFRE of the driving cycle.

As a result, from determining control transient time till the lapse of the control changeover time T FRE at S110 to S130, the driving cycle FRE of the solenoid 46 and the final energizing time I DUTYF per cycle thereof are longer (twice longer in the present embodiment) than the reference value of driving cycle KFRE. Wherein, the reference value is the steady-state driving cycle and the final energizing time (I DUTY+I DFBK). Thus, the control frequency is changed to a lower low frequency (e.g., 100 Hz) than during steady-state operation. The solenoid 46 driving cycle FRE and the final energizing time I DUTY calculated at S230, as described above, are used to switch the switching element controlling solenoid 46 in duty control for the solenoid 46 driving pulse output.

In the present embodiment, as stated above, the ECU6 for executing the calculation of control amount, common rail pressure control, and driving pulse output, functions as a control means of this invention. Also, the ECU 6 functions as a control frequency changing means performing the transient decision executed at S110 to S130 in the common rail pressure control, operations at S140 to S170 and S230.

In the common rail-type fuel injection system 1 of the present embodiment, the opening area of the fuel metering valve 40 is controlled by duty controlling the current supplied to solenoid 46 to control the actual common rail pressure Pc to the target common rail pressure P FIN. The reference value KFRE of the preset driving cycle is used as it is during steady-state operation as the solenoid 46 driving cycle FRE for the duty control. However, in the transient time of control for large changes of the opening area of the fuel metering valve 40, the driving cycle FRE and the final solenoid 46 energizing time I DUTYF per cycle are changed twice as in steady-state operation. This is done for a specific period of time (control changeover time T FRE). Then the duty control frequency is changed over to half as a low frequency as that in steady-state operation.

According to the present embodiment, therefore, the valve body 44 of the fuel metering valve 40 is quickly moved in the transient time of control, to thereby acquire control response required during the transient time.

Figure 5:
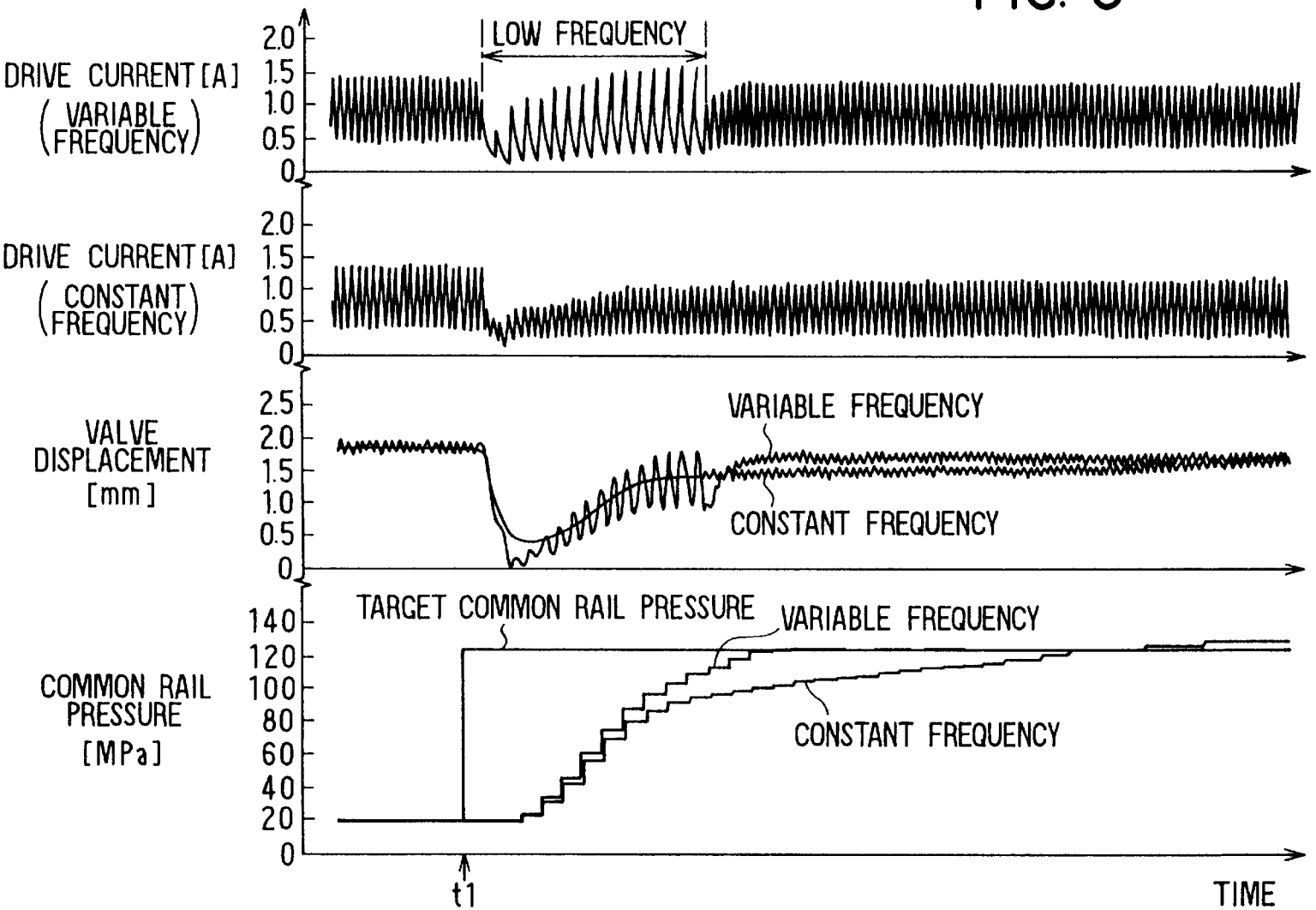
FIG. 5 is a graphical view of a time chart representing a rail pressure control operation, comparing the variable frequency control of the present invention with conventional steady-state frequency control.
Figure 6A:
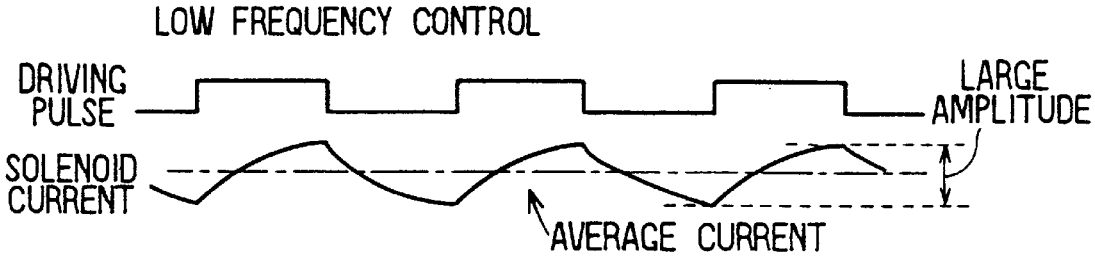
FIG. 6A is graphical view illustrating a difference in solenoid current and valve body behavior between low-frequency control and high-frequency control according to the present invention.
Figure 6B:
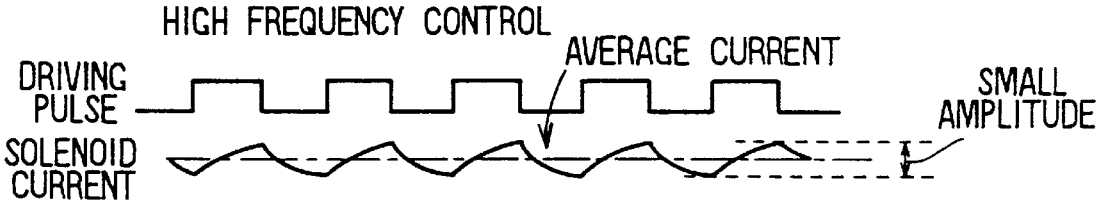
FIG. 6B is graphical view illustrating a difference in solenoid current and valve body behavior between low-frequency control and high-frequency control according to the present invention.
Figure 6C:
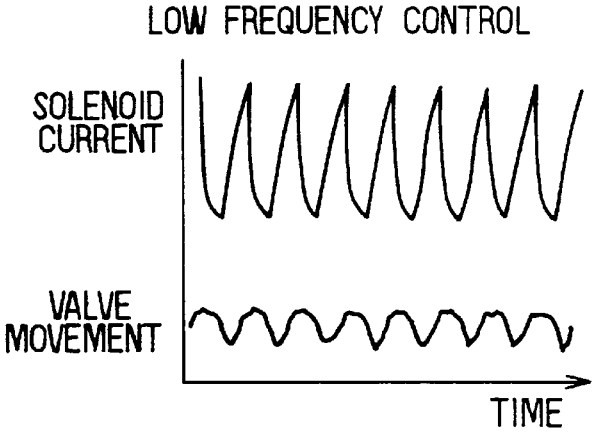
FIG. 6C is graphical view illustrating a difference in solenoid current and valve body behavior between low-frequency control and high-frequency control according to the present invention.
Figure 6D:
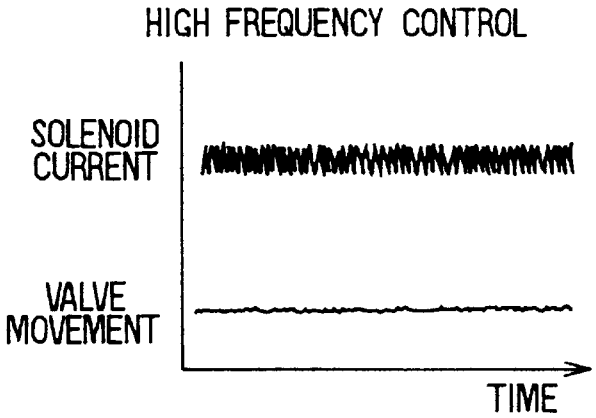
FIG. 6D is graphical view illustrating a difference in solenoid current and valve body behavior between low-frequency control and high-frequency control according to the present invention.
Figure 7A:
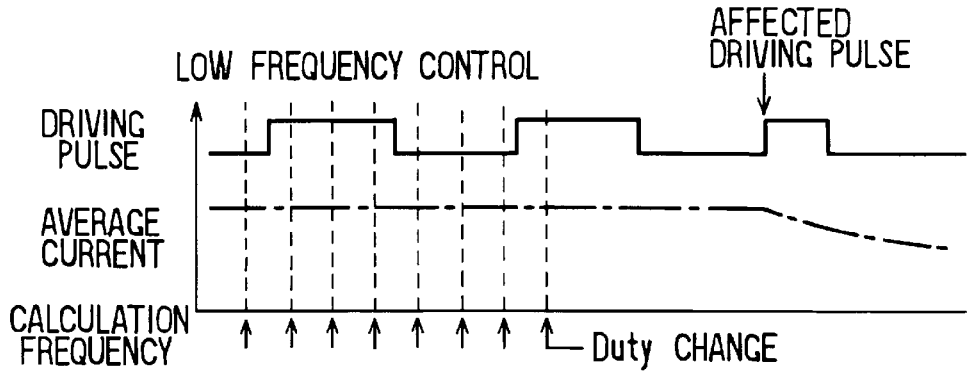
FIG. 7A is a graphical view illustrating a difference in control response between low-frequency control and the high-frequency control according to the present invention.
Figure 7B:
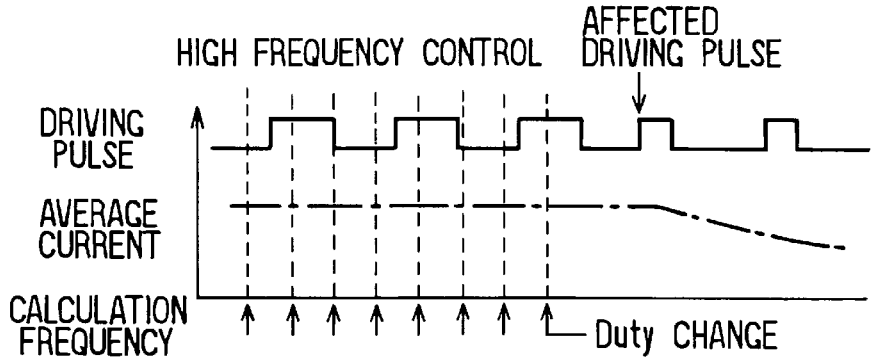
FIG. 7B is a graphical view illustrating a difference in control response between low-frequency control and the high-frequency control according to the present invention.
Figure 8A:
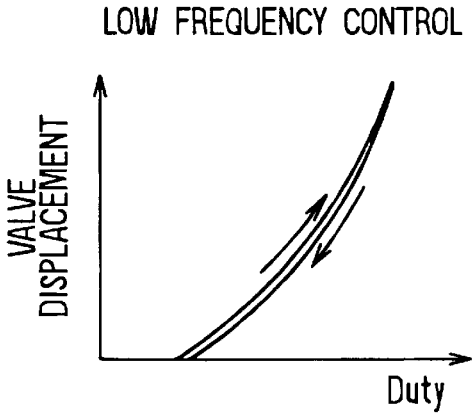
FIG. 8A (Prior Art)
FIG. 8A is a graphical view illustrating the hysteresis phenomenon of a solenoid valve in a high-frequency control according to the prior art.
Figure 8B:
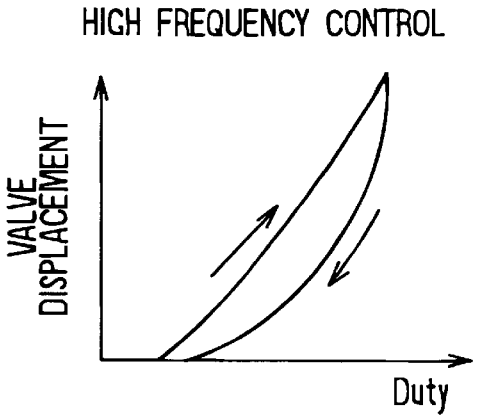
FIG. 8B (Prior Art)
FIG. 8B is a graphical view illustrating the hysteresis phenomenon of a solenoid valve in a high-frequency control according to the prior art.

For example, FIG. 5 shows a result of measurements of an actual common rail pressure behavior seen when the target common rail pressure is largely changed step by step. The measurements are carried out in two cases: in the case of the variable frequency control of the present embodiment for changing the solenoid 46 driving current control frequency from 200 Hz to 100 Hz during the transient of control, and in the case of a conventional constant frequency control with the solenoid 46 driving current control frequency constant at 200 Hz.

As shown in FIG. 5A, during variable frequency control of the present embodiment, the target common rail pressure varies at time t1, and thereafter the transient time of control s decided, changing the control frequency to a low frequency. Therefore, the amplitude of the solenoid 46 driving current increases as compares with that in the case of the constant frequency control shown in FIG. 5B. With the increase in the amplitude, the amount of lift (amount of valve lift) of the valve body 44 of the fuel metering valve 40 also varies largely, resulting in unsteady engine operation (FIG. 5C). However, since the valve body 44 in the fuel metering valve 40 moves at a higher speed than that in the constant frequency control, the common rail pressure approaches the target common rail pressure faster. From this it is understood that response during transition can be improved.

Next, in the present embodiment, a preset time KTFRE is used as the control changeover time TFRE for changing the control frequency to a low frequency after decision of transient of control. The time KTFRE is set shorter than the time required by the actual common rail pressure Pc to reach the target common rail pressure PFIN by executing the above-described common rail pressure control after the decision of transient of control. Therefore the control frequency is changed from the low frequency to the steady-state operation frequency before the actual common rail pressure Pc reaches the target common rail pressure PFIN, thereby making it possible to prevent the actual common rail pressure Pc from overshooting or undershooting in relation to the target common rail pressure PFIN. This is clear from the common rail pressure behavior in the variable frequency control shown in FIG. 5D.

One embodiment of the fuel injection system according to this invention has been explained. However, it should be noticed that this invention is not to be limited to the embodiment, since many modifications and changes may be made therein.

For example, in the above-described embodiment, the common rail-type fuel injection system which supplies the fuel to the diesel engine has been explained. This invention is applicable to either of a fuel injection system which controls the amount of fuel to be injected to each cylinder after metering the amount of fuel drawn into the distributor-type fuel injection pump which supplies the high-pressure fuel to the injector mounted in each cylinder of the diesel engine, and to a fuel injection system which supplies the high-pressure fuel directly or via a common rail to the injector mounted in each cylinder of a direct injection type gasoline engine.

In the embodiment described above, when a decision has been made on the transient of control by the transient decision processing at S110 to S130, the cycle correction factor GFRE and the control changeover time TFRE are set to preset fixed values KGFRE: e.g., 0.5, and KTFRE: e.g., 75 msec. Parameters which determine the control frequency and the frequency change time may be set in stages in accordance with the amount of change of the parameters such as the target common rail pressure PFIN, target injection quantity Q FIN, speed NE, etc. used in the transient decision. That is, it is possible to set the control frequency and its changeover time for changing over more to the low frequency side than that in the steady-state operation according to the degree of transient state of control, thereby achieving the optimum response of control.

While the above-described embodiments refer to examples of usage of the present invention, it is understood that the present invention may be applied to other usage, modifications and variations of the same, and is not limited to the disclosure provided herein.

What is claimed is:

1. A fuel injection system, comprising:

a fuel injection pump which pressurizes fuel from a feed pump to generate high pressure fuel, said fuel injection pump delivering said high pressure fuel to an internal-combustion engine;

a fuel metering valve including a solenoid valve and having an opening area which varies with an amount of current supplied to said solenoid valve, said fuel metering valve controlling a pressure of said high pressure fuel being delivered from said feed pump;

a control means for duty controlling the amount of current supplied to said solenoid valve of said fuel metering valve so that a target state of fuel being delivered from the fuel injection pump is controlled according to an operating condition of said internal-combustion engine, the control means having a control frequency changing means which changes the duty control frequency according to the operating condition of the internal-combustion engine.

2. A fuel injection system according to claim 1, wherein the fuel metering valve is mounted in a fuel supply passage extending from the feed pump to the fuel injection pump, said fuel metering valve metering the fuel being drawn into the fuel injection pump, thereby controlling the pressure of the high-pressure fuel being delivered from the fuel injection pump.

3. A fuel injection system according to claim 1, wherein the control frequency changing means changes the duty control frequency to a lower frequency than under a steady-state operation of the internal-combustion engine when the internal-combustion engine is operating in a transient condition.

4. A fuel injection system according to claim 3, wherein the control frequency changing means changes the control frequency to a lower frequency than the frequency in the steady-state operation for a specific time after a decision of transient state of the internal-combustion engine.

5. A fuel injection system according to claim 4, wherein the control frequency changing means changes, by the controlling operation of the control means, the control frequency to a lower frequency than a frequency in the steady-state operation of the internal-combustion engine for a shorter specific time than the time required by the state of fuel delivery from the fuel injection pump to reach the target state after the decision of the transient state of the internal-combustion engine.

6. A fuel injection system according to claim 1, wherein the fuel injection pump supplies fuel to a common rail which holds the high-pressure fuel, said common fuel rail supplying fuel to fuel injection valves inserted in each cylinder of the internal-combustion engine; and wherein the control means duty controls current supplied to the solenoid to supply fuel to the common rail to maintain a target state in said common rail required for controlling the actual fuel pressure in the common rail to the target fuel pressure, said control means controlling on the basis of the actual fuel pressure in the common rail, the target fuel injection quantity and the target fuel pressure when the fuel is injected from the fuel injection valve, and the speed of the internal-combustion engine.

7. A fuel injection system according to claim 6, wherein the control frequency changing means determines the transient state of the internal-combustion engine and changes the control frequency to a lower frequency than said steady-state operation when said target fuel injection quantity, target fuel pressure, or speed of the internal-combustion engine exceeds a preset transient decision value.

8. A fuel injection system, comprising:

a fuel injection pump which pressurizes fuel from a feed pump to generate high pressure fuel, said fuel injection pump delivering said high pressure fuel to an internal-combustion engine;

a fuel metering valve including a solenoid valve and having an opening area which varies with an amount of current supplied to said solenoid valve, said fuel metering valve controlling a pressure of said high pressure fuel being delivered from said feed pump;

a controller that controls the amount of current supplied to said solenoid valve of said fuel metering valve so that a target state of fuel being delivered from the fuel injection pump is controlled according to an operating condition of said internal-combustion engine, the controller having a control frequency changer which changes the duty control frequency according to the operating condition of the internal-combustion engine.

9. A fuel injection system according to claim 8, wherein the fuel metering valve is mounted in a fuel supply passage extending from the feed pump to the fuel injection pump, said fuel metering valve metering the fuel being drawn into the fuel injection pump, thereby controlling the pressure of the high-pressure fuel being delivered from the fuel injection pump.

10. A fuel injection system according to claim 8, wherein the control frequency changer changes the duty control frequency to a lower frequency than under a steady-state operation of the internal-combustion engine when the internal-combustion engine is operating in a transient condition.

11. A fuel injection system according to claim 10, wherein the control frequency changer changes the control frequency to a lower frequency than the frequency in the steady-state operation for a specific time after a decision of transient state of the internal-combustion engine.

12. A fuel injection system according to claim 11, wherein the control frequency changer changes, by the controlling operation of the controller, the control frequency to a lower frequency than a frequency in the steady-state operation of the internal-combustion engine for a shorter specific time than the time required by the state of fuel delivery from the fuel injection pump to reach the target state after the decision of the transient state of the internal-combustion engine.

13. A fuel injection system according to claim 8, wherein the fuel injection pump supplies fuel to a common rail which holds the high-pressure fuel, said common fuel rail supplying fuel to fuel injection valves inserted in each cylinder of the internal-combustion engine; and wherein the controller duty controls current supplied to the solenoid to supply fuel to the common rail to maintain a target state in said common rail required for controlling the actual fuel pressure in the common rail to the target fuel pressure, said controller controlling on the basis of the actual fuel pressure in the common rail, the target fuel injection quantity and the target fuel pressure when the fuel is injected from the fuel injection valve, and the speed of the internal-combustion engine.

14. A fuel injection system according to claim 13, wherein the control frequency changer determines the transient state of the internal-combustion engine and changes the control frequency to a lower frequency than said steady-state operation when said target fuel injection quantity, target fuel pressure, or speed of the internal-combustion engine exceeds a preset transient decision value.

* * * * *